US009056238B2

(12) United States Patent
Fisher et al.

(10) Patent No.: US 9,056,238 B2
(45) Date of Patent: Jun. 16, 2015

(54) SHIN GUARD STRAP

(75) Inventors: Sam Fisher, Portland, OR (US); Carl Behrend, Portland, OR (US); Oliver McLachlan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 425 days.

(21) Appl. No.: 12/910,153

(22) Filed: Oct. 22, 2010

(65) Prior Publication Data

US 2012/0096615 A1 Apr. 26, 2012

(51) Int. Cl.

| | |
|---|---|
| ***A41D 13/00*** | (2006.01) |
| ***A63B 71/12*** | (2006.01) |
| ***A41D 13/06*** | (2006.01) |
| ***A41D 13/05*** | (2006.01) |

(52) U.S. Cl.

CPC ..... *A63B 71/1225* (2013.01); *A41D 13/065* (2013.01); *A41D 13/0543* (2013.01); *A41D 13/0568* (2013.01); *A63B 2071/1258* (2013.01); *A63B 2209/10* (2013.01); *A63B 2243/0025* (2013.01)

(58) Field of Classification Search

CPC ..... A63B 71/1225; A63B 2071/1258; A41D 13/0543; A41D 13/0568; A41D 13/065

USPC ..... 2/22, 24, 62, 911, 456, 455, 23, 311, 2/267, 268; 128/882, 878; 602/20–23, 602/62, 26–27, 4, 13, 16; D29/120.1, 122

See application file for complete search history.

(56) References Cited

U.S. PATENT DOCUMENTS

| | | | | |
|---|---|---|---|---|
| 1,184,868 | A * | 5/1916 | Pierce | 2/22 |
| 4,674,157 | A * | 6/1987 | Litz | 24/442 |
| 5,544,663 | A | 8/1996 | Duback | |
| 5,829,055 | A | 11/1998 | Collins et al. | |
| 6,237,149 | B1 | 5/2001 | MacDonald | |
| 2005/0114976 | A1 | 6/2005 | Beland et al. | |

(Continued)

FOREIGN PATENT DOCUMENTS

| | | | |
|---|---|---|---|
| CN | 2530675 | Y | 1/2003 |
| DE | 29910034 | U1 | 7/1999 |

(Continued)

OTHER PUBLICATIONS

Notification of Transmittal of the International Search Report and the Written Opinion of the International Searching Authority, or the Declaration, in PCT/US11/57329, mailed Mar. 22, 2012, 16 pages.

(Continued)

*Primary Examiner* — Danny Worrell
*Assistant Examiner* — Khaled Annis
(74) *Attorney, Agent, or Firm* — Shook, Hardy & Bacon L.L.P.

(57) ABSTRACT

Aspects of the present invention relate to a shin guard construction having a shin guard and a strap. The strap may provide a number of adjustments, such as adjusting a vertical position of strap attachment to the shin guard, a length of the strap, and/or a position of a portion of the strap in both a horizontal and/or a vertical location on a wearer's leg. Further, the strap may have an upwardly inclined orientation relative to a horizontal plane extending through the shin guard. The orientation of the strap in an upward direction may be a result of a location and/or orientation of one or more fasteners. Additionally, the orientation of the strap may be a result of the size and/or shape of the strap.

20 Claims, 5 Drawing Sheets

(56) References Cited

U.S. PATENT DOCUMENTS

| | | | |
|---|---|---|---|
| 2006/0096000 | A1 | 5/2006 | Romero et al. |
| 2006/0191051 | A1 | 8/2006 | Garcia |
| 2007/0163025 | A1 | 7/2007 | Godshaw et al. |
| 2009/0100563 | A1 | 4/2009 | Behrend et al. |
| 2011/0083243 | A1 | 4/2011 | Bristrup |

FOREIGN PATENT DOCUMENTS

| | | | |
|---|---|---|---|
| DE | 102008021755 | A1 | 11/2009 |
| FR | 2600900 | A1 | 1/1988 |
| GB | 801783 | A | 9/1958 |
| WO | 2008057510 | A2 | 5/2008 |

OTHER PUBLICATIONS

Uhisport Vyper Comfort Shin Guard (online) Uhisport, Feb. 21, 2012 [retrieved on Feb. 27, 2012] retrieved from web. archive.org through the Internet: <URL:http://web.archive.org/web/20100221215305/http;//www.soccer.com/IWCatProductPage.process?merchant_Id=1&Section_Id=1&pcount=&Product_Id=484283>, 6 pages. (attached to Search Report).

European Extended Search Report dated May 15, 2014 in Application No. 11835234.3, 11 pages.

* cited by examiner

SHIN GUARD STRAP

BACKGROUND

Traditionally, a shin guard is used by an athlete to protect the shin region of the athlete from an impact. Shin guards, in an as-worn position, generally extend from below the knee to a location superior of the ankle. However, the general size and shape of the protective portion of the shin guard may vary. A wearer of the shin guard may place the shin guard against the shin and under a sock to secure the shin guard into a position. Additionally, a shin guard may have a strap that extends perpendicular to the shin guard to help secure the shin guard when worn. However, both of these methods of securing the shin guard may allow the shin guard to shift or otherwise move out of position relative to a wearer's leg.

SUMMARY

Aspects of the present invention relate to a shin guard construction having a shin guard and a strap. The strap may provide a number of adjustments, such as adjusting a vertical position of strap attachment to the shin guard, a length of the strap, and/or a position of a portion of the strap in both a horizontal and/or a vertical location on a wearer's leg. Further, the strap may have an upwardly inclined orientation relative to a horizontal plane extending through the shin guard. The orientation of the strap in an upward direction may be a result of a location and/or orientation of one or more fasteners. Additionally, the orientation of the strap may be a result of the size and/or shape of the strap.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
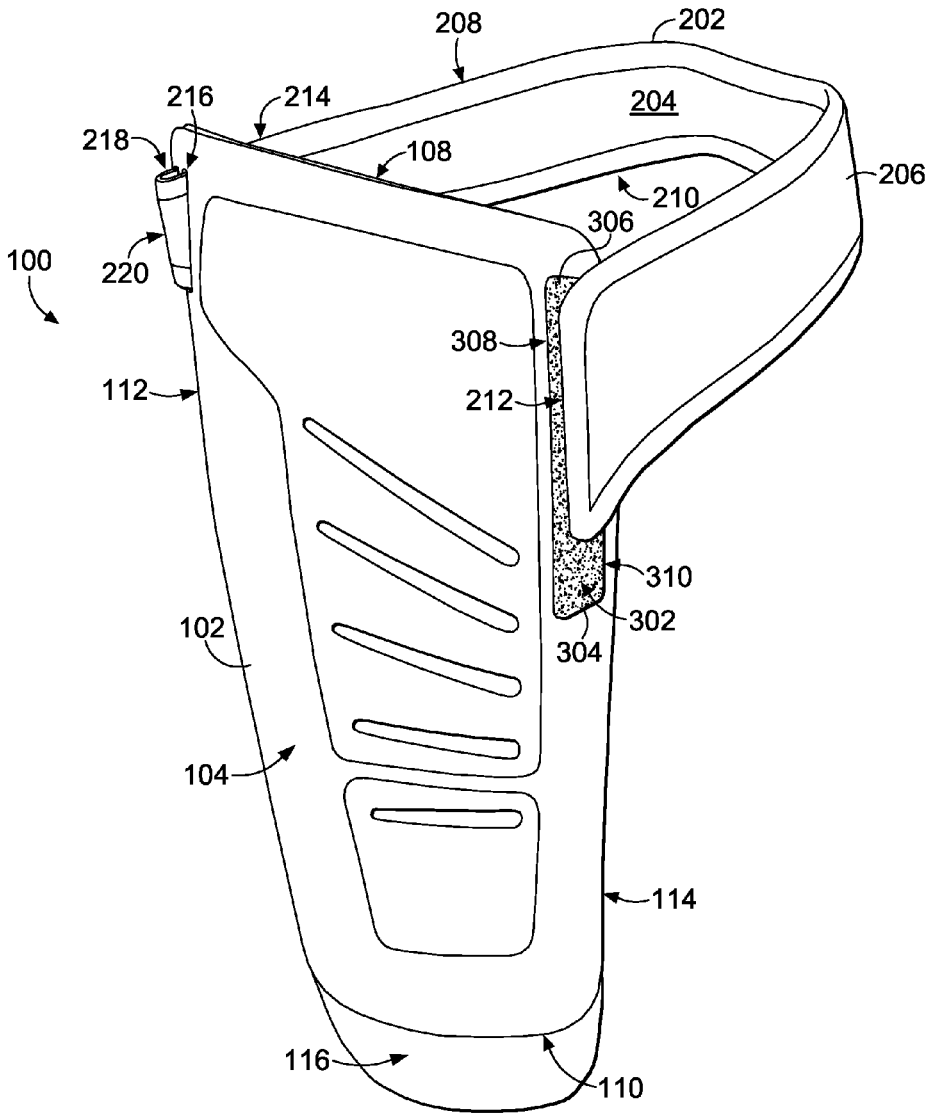
FIG. 1 depicts a frontal view of a shin guard having a strap affixed to a lateral side and a medial side, in accordance with embodiments of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects of the present invention relate to a shin guard construction having a shin guard and a strap. The strap and shin guard may provide a number of adjustments, such as adjusting a vertical position of strap attachment to the shin guard, a length of the strap, and/or a position of a portion of the strap in both a horizontal and/or a vertical location on a wearer's leg. Further, the strap may have an upwardly inclined orientation relative to a horizontal plane extending through the shin guard. The orientation of the strap in an upward direction may be a result of a location and/or orientation of one or more fasteners. Further, the orientation of the strap may be a result of the size and/or shape of the strap.

Accordingly, in one aspect, the present invention provides a shin guard construction. The shin guard construction has a shin guard with a bottom end and an opposite top end. The shin guard also has opposite right and left sides extending between the bottom end and the top end. Additionally, the shin guard has a front surface and a back surface. The shin guard construction also has a strap of flexible material that has a top edge and an opposite bottom edge. The strap also has opposite left and right ends extending between the top edge and the bottom edge. One of the right end or the left end of the strap has a first fastener that is fastenable to the strap itself. The other of the right end or the left end has a second fastener that is fastenable to the shin guard. The strap, when affixed to the shin guard by both the first fastener and the second fastener, extends in an upward orientation from at least one of the first fastener or the second fastener. The upward orientation is measured from a horizontal plane passing perpendicularly through the front surface and the rear surface of the shin guard.

In another aspect, the present invention provides a shin guard construction. The shin guard has a front surface and a back surface. The shin guard also has a bottom end and an opposite top end. Further, the shin guard has opposite medial and lateral sides extending between the bottom end and the top end. The lateral side is longer than the medial side. The shin guard construction additionally has a strap extending, from a first strap location on the shin guard, in a direction from the front surface to the back surface proximate the lateral side of the shin guard. The strap extends to the medial side of the shin guard at a second fastening location. The strap is adjustably affixable to the shin guard at the first location and the second fastening location. Further, the strap extends at an upward orientation relative to a horizontal plane extending perpendicularly through the front surface and the back surface.

A third aspect of the present invention provides a shin guard construction. The shin guard construction has a shin guard with a bottom end and an opposite top end. The shin guard also has opposite medial and lateral sides extending between the bottom end and the top end. The lateral side has a length between the bottom end and the top end that is longer than a length of the medial side between the bottom end and the top end. The shin guard construction also has a strap of flexible material. The strap has a top edge and an opposite bottom edge as well as opposite medial and lateral ends extending between the top edge and the bottom edge. The medial end of the strap has a width between the top edge and the bottom edge of the strap that is wider than a width of the lateral end between the top edge and the bottom edge of the strap. Further, the strap has a first fastener proximate the lateral end, wherein the strap is affixable to the shin guard near the lateral side of the shin guard utilizing the first fastener. Additionally, the strap has a second fastener proximate the medial end. The strap is affixable to the shin guard near the medial side of the shin guard utilizing the second fastener. The top edge of the strap extends higher than the top end of the shin guard in a direction defined as extending from the bottom end toward the top end of the shin guard when the strap is affixed to the shin guard utilizing both the first fastener and the second fastener.

Having briefly described an overview of embodiments of the present invention, a more detailed description follows The construction of a shin guard 100 of the present invention has the basic construction of a soccer-type shin guard. However, the shin guard 100 is comprised of a strap 202 that extends away from the shin guard 100 at an upwardly orientation to encircle a wearer's calf at a point higher than if the strap extended perpendicularly outward from the shin guard. Additionally, the strap 202 may be adjustable in length and also adjustable in a vertical coupling location. The shin guard 100 provides a unique contouring connection mechanism that provides a secure and stable attachment to a wearer. The shape, size, and/or orientation of the strap 202 may allow, in some aspects, the strap 202 to rest on the calf above the widest portion of the calf. By positioning the strap 202 above the calf, the strap 202 may not have enough elasticity to expand around or over the wider portion of the calf that is below the strap 202 in an as-worn position.

In aspects of the present invention, the shin guard 100 is a soccer-style shin guard. However, it should be understood that the novel concept of the invention could be employed on other types of shin guards. Because much of the construction of the shin guard 100 is the same as that of a conventional shin guard, the conventional features of the constructions will be described only generally herein.

The shin guard 100 is constructed with an outer cover 102. The outer cover 102 may be a rigid or semi-rigid material that acts as a distributor of impact force. For example, the outer cover 102 may be constructed from a polymer-based material that is formed to contour to a wearer's shin region. Therefore, if an impact is experienced by the outer cover 102, the force of the impact is distributed over a larger surface area of the wearer's shin region as a result of the rigid properties of the outer cover 102.

The body of the shin guard 100 is also constructed with an inner liner 116. In an exemplary embodiment, the inner liner 116 is a cushioning material functional for absorbing force. For example, a foam material may be formed as the inner liner 116. The inner liner may coincide with the dimensions of the outer cover 102. Therefore, in an exemplary embodiment, the body of the shin guard 100 is comprised of a lamination of the outer cover 102 and the inner liner 116 to form a cohesive shin guard body.

However, in an alternative exemplary embodiment, the inner liner 116 may have a larger dimension in one or more location relative to the outer cover 102. For example, the inner liner 116 may extend below a bottom end 110 of the outer cover 102, as best depicted in FIG. 1. The additional dimension may provide additional absorption characteristics to not only absorb impact energy experienced by the outer cover 102, but also impacts experiences at a location of the excess inner liner 116. Additionally, the excess dimensions of inner liner 116 may provide a more comfortable fit for a wearer as compared to the outer cover 102 extending to the edges of the shin guard 100.

The shin guard 100 may be defined as having a top end 108, the bottom end 110, a medial side 114, and a lateral side 112. As used herein, the terms medial and lateral may be relative to a wearer of the shin guard 100. For example, a shin guard 100 may be specifically dimensioned for either a wearer's right side or the wearer's left side. Consequently, an item described as either a left or a right may be on a medial side or a lateral side of the shin guard 100 depending on a side of the wearer in which the shin guard 100 could be positioned. Further to this point, herein specific reference may be made to medial and lateral when discussing portions, parts, features, and the like; but, it is understood that applying the opposite terminology (e.g., when medial is stated, lateral may also be applied) is contemplated as being within the scope of the present invention. For example, FIG. 1 depicts a shin guard adapted to be worn on a right leg of a wearer. A similar shin guard adapted to be worn on the left leg of the wearer could be a mirror image of the shin guard depicted in FIG. 1. A mirror image for an opposite leg of the wearer may allow the shin guard to achieve the desired secured fit and positioning for which the shin guard has been designed to achieve.

Figure 3:
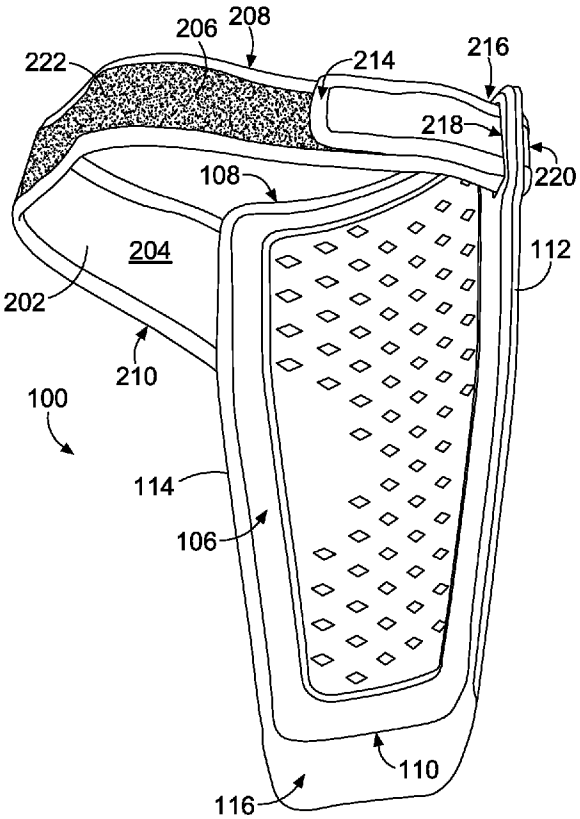
FIG. 3 depicts a back perspective of a shin guard having a strap affixed to a shin guard by passing through a first opening and a second opening.

The shin guard 100 also has an outer surface 104. The outer surface 104 is a surface that extends away from a wearer when in an as-worn position. Typically, the outer surface 104 is the surface facing an incoming object for which the shin guard 100 is intended to provide protection. Opposite of the outer surface 104, the shin guard 100 has an inner surface 106, as best seen in FIG. 3. The inner surface 106 is the surface that is typically facing a wearer's shin when the shin guard 100 is in an as-worn position. In an exemplary embodiment, the inner surface 106 is a surface defined by a surface of the inner liner 116. However, it is understood that additional material or elements may be disposed between the inner liner 116 and a wearer in aspects of the present invention.

The shin guard 100 is also comprised of the strap 202. The strap 202, in an exemplary embodiment, is constructed from flexible material. For example, the flexible strap 202 may be constructed from any one or combination of webbing, cord, fabric, hook-and-loop material, binding, leather, synthetic leather, vinyl, nylon, other polymer-based materials, or the like. In an aspect, the strap 202 is constructed from a non-elastic material as the lack of ability to stretch may allow the strap to secure the shin guard 100 in a more secure manner than an elastic material. The lack of elasticity in the strap 202, in an aspect, may prevent the strap 202 from expanding to pass over a wider portion of a wearer's calf that is posterior to the strap 202 in an as-worn position. Further, it is contemplated that a limited elasticity is provided in the strap 202, such that the maximum stretch provided by the strap 202 is less than an amount necessary for the strap 202 to expand around the wider portion of the calf. Regardless, aspects contemplate the strap 202 resting on an upper portion of the calf of a wearer in an as-worn position to help secure the shin guard 100.

Figure 4:
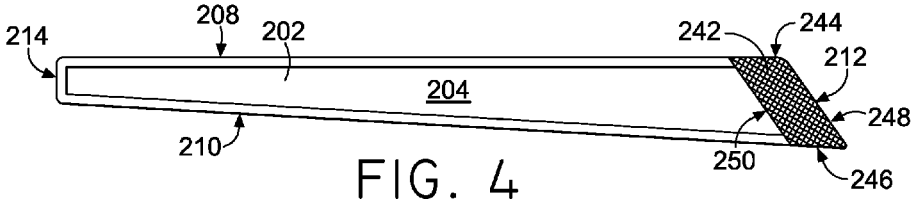
FIG. 4 depicts a first surface of a strap in an un-affixed position, in accordance with embodiments of the present invention.
Figure 5:
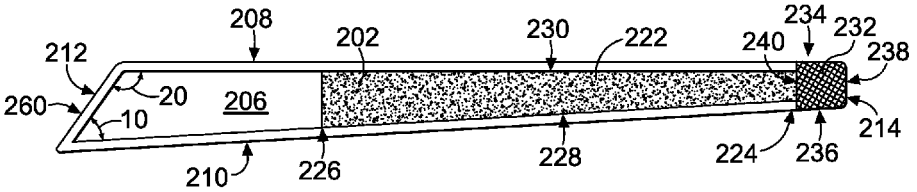
FIG. 5 depicts a second surface of a strap in an un-affixed position, in accordance with embodiments of the present invention.

A perimeter of the strap may be defined by a top edge 208 and a bottom edge 210. The perimeter also is comprised of a medial side 212 and an opposite lateral side 214. However, it is understood, that aspects of the present invention provide that the top edge 208 and the bottom edge 210 are not parallel to one another along the length of the strap 202. For example, as best illustrated in FIGS. 4 and 5, the overall shape of the strap 202 may be a trapezium where none of the sides are parallel to one another. In other words, the length of the top edge 208 may be less than the length of the bottom edge 210, where the medial side 212 comprises an outer edge 260 that may form an acute angle 10 with the bottom edge 210 and an obtuse angle 20 with top edge 208. Additional aspects of the present invention may have the strap 202 shaped as a trapezoid having two sides parallel to one another.

The strap 202 has a first surface 204 and an opposite second surface 206. In an as-worn position, a majority of the first surface 204 is facing and may be in contact with a wearer's skin. Conversely, in an as-worn position, the second surface 206 of the strap 202 maybe facing away from a wearer's leg. In an exemplary embodiment, the material utilized to construct, at least a portion, of the first surface 204 may include materials that have a higher coefficient of friction relative to an a wearer's skin or other contacting surface. For example, to aid in maintaining the shin guard 100 as a whole, and the strap 202 in particular, in a desired position, the increased coefficient of friction may be desired. Examples of materials suitable for this purpose include, leather, synthetic leather, silicon based materials, or polymer based materials.

As best illustrated in FIG. 4, a first fastener 242 is attached to the first surface 204. In an exemplary embodiment, the first fastener is a hook or a loop material; however, other fasteners are contemplated herein. For example, other fasteners may include snaps, buttons, tape, hooks, catches, compression closures, or the like. The first fastener 242 has a top edge 244, an outer edge 248, an inner edge 250, and a bottom edge 246. The width of the first fastener 242 is defined as extending from the inner edge 250 to the outer edge 248. The length of the first fastener 242 is defined as extending from the bottom edge 246 to the top edge 244.

In exemplary aspects, the outer edge 248 is proximate to the strap's medial side 212, as illustrated best in FIG. 4. Similarly, the top edge 244 and/or the bottom edge 246 may be positioned proximate a respective edge of the strap 202. The shape of the first fastener 242, when constructed from a shapeable material such as a hook and/or loop material, may correspond to that of the underlying portion of the strap 202. By corresponding in shape, the first fastener 242 may attach, even temporarily, to a respective connector (e.g., the other of a hook or loop material) on the shin guard 100 or even on another portion of the strap 202 without interference from the strap 202 itself.

Figure 2:
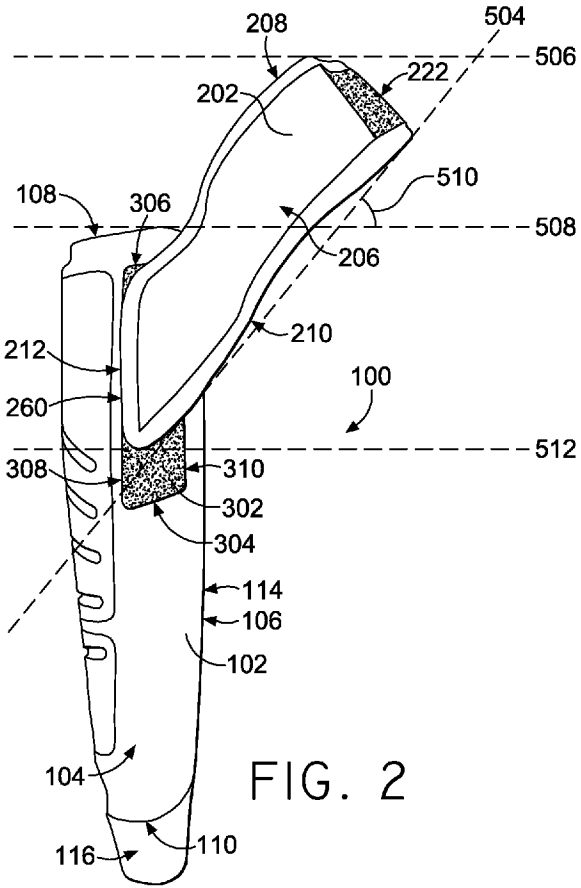
FIG. 2 depicts a medial side view of a shin guard, in accordance with embodiments of the present invention.

The shin guard 100 has a fastener portion 302, as illustrated in FIGS. 1 and 2, that is functional for receiving the first fastener 242. The fastener portion 302 has an upper edge 306 and an opposite lower edge 304. The fastener portion 302 also has a forward edge 308 and an opposite back edge 310. The width of the fastener portion 302 is defined as extending from the forward edge 308 to the back edge 310. The length of the fastener portion 302 is defined as extending from the lower edge 304 to the upper edge 306. In an exemplary embodiment, the fastener portion 302 is a portion of a hook and loop fastener. For example, if the first fastener 242 is a hook material, the fastener portion 302 may be a loop material. However, as previously discussed any of the fasteners discussed herein, including the fastener portion 302, may be any type of fastener for securing, either permanently or temporarily, a first portion to a second portion. For example, an exemplary fastener may be a button, snap, hook and loop material, zipper, stitching, sewing, adhesive, hook, eyelet, lacing, ratcheting mechanism, or the like.

The size and shape of the first fastener 242 and or the fastener portion 302 may vary depending on an amount of adjustability desired. For example, in an exemplary embodiment, the width of the first fastener 242 may be similar to the width of the fastener portion 302. However, in an additional exemplary embodiment, one width of the first fastener 242 or the fastener portion 302 may be larger than the other. In this example, a size of the strap 202 presented to a wearer's leg in an as-worn position may be altered by lengthening or reducing the amount of strap extending from the lateral side 112 to the medial side 114 of the shin guard 100. Additionally, as will be discussed hereinafter, the position of the strap 202 or a position of a portion of the strap 202 may be adjusted in this example when additional adjustments may occur closer to the lateral side 214 of the strap 202.

The fastener portion 302 may have a length that extends the length or a portion of the length of the shin guard 100. In an exemplary embodiment, the length of the fastener portion 302 is greater than the length of the first fastener 242. In this example, the strap 202 may be adjusted vertically to compensate for differences in a wearer's anatomy. For example, to better contour a wearer's calf muscle structure, the wearer may desire to adjust the vertical placement of the strap 202 when affixed to the shin guard 100 by adjusting where the first fastener 242 affixes along the length of the fastener portion 302.

Moving to the lateral side 214 on the second surface 206 of the strap 202, as best seen in FIG. 5, the strap 202 has a second fastener 232. The second fastener has a perimeter defined by a top edge 234, an opposite bottom edge 236, an inner edge 240, and an opposite outer edge 238. Similarly, on the second surface 206 of the strap 202, a third fastener 222 is positioned. The third fastener 222 has a perimeter defined by a top edge 230, an opposite bottom edge 228, an inner edge 226, and an opposite outer edge 224.

The second fastener 232 and the third fastener 222, in an exemplary embodiment, are a hook and/or loop material. For example, the second fastener 232 may be a hook material and the third fastener 222 may be a loop material or the like. Consequently, it is contemplated that the second fastener 232 and the third fastener 222 operate in conjunction with one another to provide a method of adjusting the strap 202 when in an as-worn position by a wearer.

As illustrated in FIG. 5, the second fastener 232 may be sized to correspond with an underlying portion of the strap 202. For example, the outer edge 238 may be aligned with the lateral side 214 of the strap 202. Similarly the top edge 234 and the bottom edge 236 may align with the respective top edge 208 and the bottom edge 210 of the strap 202. However, it is contemplated that one or more edges of the second fastener 232 do not align with the underlying portion of the strap 202.

The third fastener 222 may be sized to correspond with an underlying portion of the strap 202. For example, the top edge 230 and the bottom edge 228 may align or be spaced from the respective top edge 208 and the bottom edge 210 of the strap 202. Additionally, it is contemplated that an edging or binding material may be utilized along a part or the whole of the perimeter of the strap 202, which may obscure a portion of the second fastener 232 and/or the third fastener 222.

Figure 7:
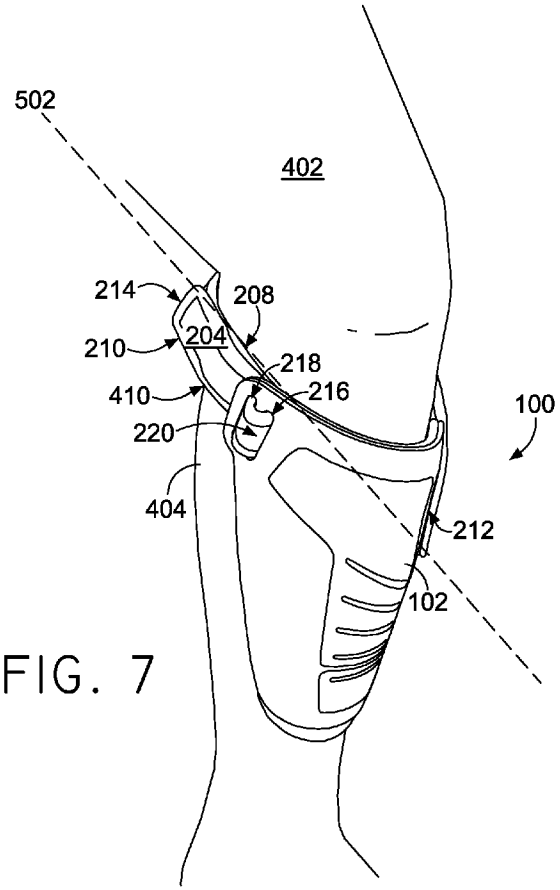
FIG. 7 depicts a lateral view, in an as-worn position, of a shin guard, in accordance with embodiments of the present invention.

As best seen in FIG. 7, the shin guard 100 has a first opening 216 and a second opening 218. The first opening 216 and the second opening 218 are openings functional for receiving a portion of the strap 202. For example, the first opening and the second opening 218 may be sized to allow the lateral side 214 of the strap 202 to extend through each of the openings. The first opening 216 may be parallel in orientation to the second opening 218. Both the first opening 216 and the second opening 218 may be discrete openings, such as a slot shaped opening that provides an aperture through which the strap 202 may pass.

Consequently, the shin guard 100 is effective to receive the strap 202 such that the strap 202 is affixed to the shin guard 100 by way of the strap 202 extending through the first opening 216 and/or the second opening 218. As illustrated at FIG. 7, the lateral side 214 may pass, from the inner surface 106 to the outer surface 104, through the first opening 216. Consequently, the lateral side 214 may then pass, from the outer surface 104 to the inner surface 106, through the second opening 218. This "threading" of the strap 202 through the first opening 216 and the second opening 218 creates a turnback portion 220 of the strap 202. The turnback portion 220 is the portion of the strap 202 that is exposed proximate the outer surface 104.

The threading of the strap 202 through the outer cover 102 and the inner liner 116 allows the strap 202 to be affixed to the shin guard 100, in an exemplary embodiment. Additional exemplary aspects include permanently or removeably affixing the strap 202 directly or indirectly to the outer cover 102, the inner liner 116, or other portions of the shin guard 100. For example, the strap 202, as previously discussed, may be affixed to a portion of the shin guard utilizing other fastening methods. For example, the strap 202 may be secured directly to the shin guard 100 utilizing snaps, hook and loop, buttons, clips, stitching, and the like in place of or in combination to the apertures 216 and/or 216.

Individually or in combination, the first fastener 242, the second fastener 232, the third fastener 222, the fastener portion 302, the first opening 216, and/or the second opening 218 allow the strap to be adjusted in a plurality of ways. For example, the length of the strap that extends between the lateral side 112 to the medial side 114 may be adjusted utilizing one or more of the fasteners discussed above. Further, the height and even the angle (to be discussed hereinafter) may be adjusted utilizing one or more of the fasteners discussed above.

Turning now to the orientation of the strap 202 when affixed, either partially or fully, to the shin guard 100. The strap 202, in an exemplary embodiment, maintains an upwardly inclined orientation relative to a horizontal plane extending through the outer surface 104 and the inner surface 106. For example, the strap 202 is upwardly oriented as depicted by line 504 (as seen in FIG. 2) relative to horizontal planes depicted by lines 512, 508 and 506. The upward angle may be measured as angle 510.

Figure 6:
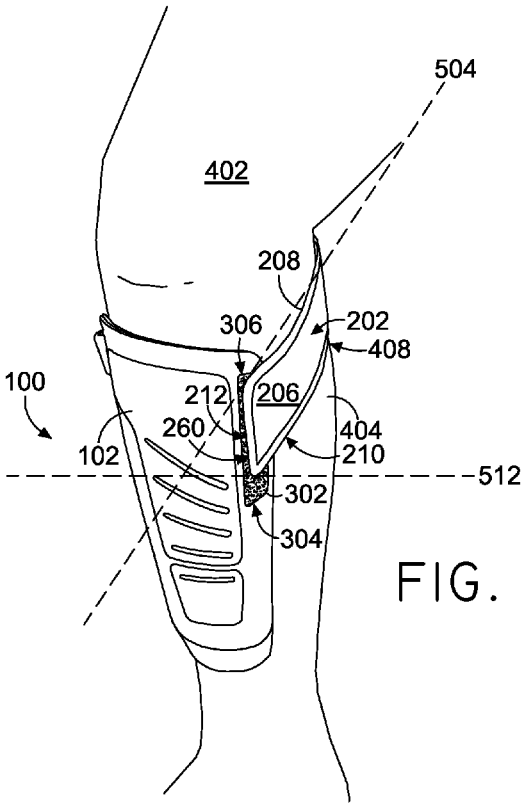
FIG. 6 depicts a medial view, in an as-worn position, of a shin guard, in accordance with embodiments of the present invention.

The upward angle depicted by the line 504 represents a general angular trend of the strap 202 along the medial side 114. It is understood that the strap 202, as a flexible material, may be best described as having an upward orientation as the strap 202 may waver, flex, or otherwise distort along one or more portions. Consequently, when discussed herein, the upward angular orientation may be a trend of the strap 202 for a portion or as a whole. For example, as seen in FIG. 7, a line 502 depicts an upward angular trend of the strap 202. However, it is contemplated that the upward angular orientation depicted by the line 502 may be different from the upward orientation depicted by the line 504 (as seen in FIG. 6). A discrepancy in the angle may result from the shape of the strap 202. For example, if the top edge 208 and the bottom edge 210 deviate from parallel at different portion or across the whole of the strap 202. The resulting angular orientation from the lateral side 112 to the medial side 114 may be different. Additionally, an orientation of the strap 202 proximate a point of coupling with the shin guard 100 may further change the angular orientation represented by lines 502 and 504

An orientation of the strap 202 is, in an exemplary embodiment, influenced by the location and orientation of the first opening 216 and the second opening 218. For example, it is contemplated that the first opening 216 is located lower, measured from the top end 108 to the bottom end 110, than the second opening 218. In this example, as the strap 202 extends away from the inner surface after passing through the second opening 118, the strap inherently extends at an upward angle when the turnback portion 220 is taught. Similarly, an irregular shaping (e.g., trapezium, trapezoidal) of the strap 202 may facilitate the upward orientation of the strap 202.

In an additional exemplary embodiment, the top edge 208 of the strap 202 is higher than the top end 108 of the shin guard 100. As seen in FIG. 2, the height of the top edge 208, as measured in a direction extending from the bottom end 110 through the top end 108, is depicted by the line 506. The height of the top end 108, as also measured in a direction extending from the bottom end 110 through the top end 108, is depicted by the line 508. As depicted in FIG. 2, the top edge 208 is "higher" than the top end 108 when the strap 202 is affixed to the shin guard 100.

As previously discussed, the strap 202 is functional to surround a leg 402 proximate an upper portion of a calf 404 of the wearer. The strap 202, in an as-worn position, may contact the upper portion of the calf on a medial side proximate a point 408 (depicted in FIG. 6). Similarly, the strap 202, in an as-worn position, may contact the upper portion of the calf on a lateral side proximate a point 410 (depicted in FIG. 7). In an exemplary embodiment, the orientation, shape, and/or size of the strap 202 is selected to allow the strap to rest, in an as-worn position, at a point on a wearer's calf that is superior to the widest portion of the calf muscle. For example, the calf region of a wearer may be defined by two prominent portions of the calf muscle that have different posterior heights at which they are the widest. Consequently, the point 408 may be higher (i.e., superior) or lower (i.e., inferior) to that of the point 410. In an aspect, the strap 202 has a shape and orientation that allows the strap 202 to rest, in an as-worn position, above the calf region of the wearer at an approximately similar height taking into account the lack of symmetry between the two prominent portions of the calf.

Consequently, the upward orientation of the strap 202 may allow for the shin guard 100 to be positioned in a traditional location along the shin posterior of a wearer's knee while having the strap 202 extend, naturally, around an upper portion of the wearer calf on the backside of the leg. Additionally, an angle at which the strap 202 contacts the wearer's leg may be adjusted on the lateral side and the medial side utilizing the various fasteners discussed herein.

The following is an overview of the figures provided herewith. FIG. 1 depicts a frontal view of the shin guard 100 having the strap 202 affixed to the lateral side 112 and the medial side 114 in accordance with aspects of the present invention. FIG. 2 depicts a medial side view of the shin guard 100, in accordance with aspects of the present invention. FIG. 2 illustrates the "height" of the strap 202 relative to the top end 108 by the lines 506 and 508 respectively. Additionally, FIG. 2 depicts the medial side upward orientation 510 of the strap 202 as shown by the line 504, where the strap 202 when affixed to the fastener portion 302, has exterior edge 260 in a substantially perpendicular orientation relative to the horizontal plane 512. FIG. 3 depicts a back perspective of the shin guard 100 having the strap 202 affixed to the shin guard 100 by passing through the first opening 216 and the second opening 218. The strap 202 utilizes the second fastener 232 and the third fastener 222 to maintain the positioning of the strap 202.

Figure 8:
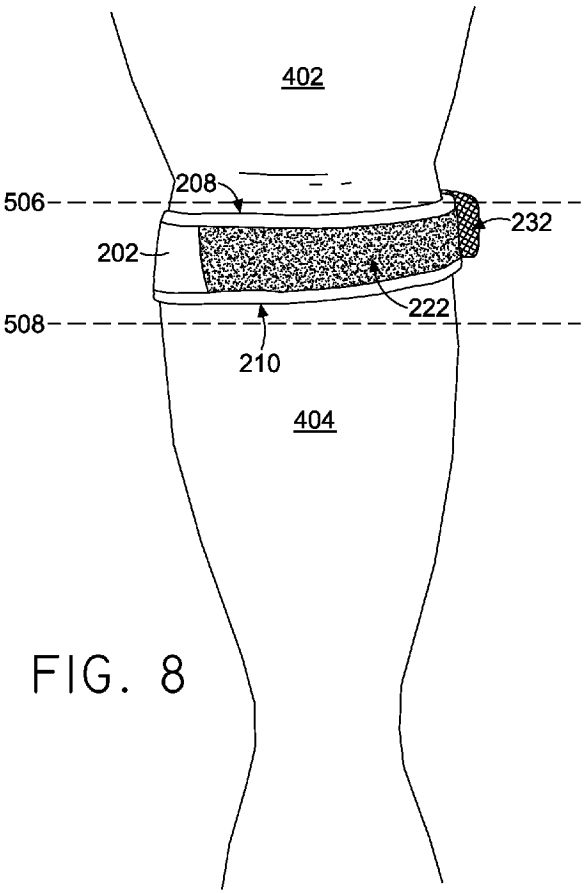
FIG. 8 depicts a rear view, in an as-worn position, of a shin guard, in accordance with embodiments of the present invention.

FIG. 4 depicts the first surface 204 of the strap 202 in an un-affixed position, in accordance with emblements of the present invention. FIG. 5 depicts the second surface 206 of the strap 202 in an un-affixed position, in accordance with aspects of the present invention. FIG. 6 depicts a medial view, in an as-worn position, of the shin guard 100, in accordance with aspects of the present invention. FIG. 6 also depicts an upward orientation of the strap 202 from a medial side, as depicted by the line 506, when the strap 202 is affixed to both a medial side and a lateral side of the shin guard 100. FIG. 7 depicts a lateral view, in an as-worn position, of the shin guard 100, in accordance with aspects of the present invention. FIG. 7 also depicts an upward orientation of the strap 202 on a lateral side, as depicted by the line 502. FIG. 8 depicts a rear view in an as-worn position of the shin guard 100, in accordance with aspects of the present invention. FIG. 8 also depicts a difference in height of the top edge 208 of the strap 202 relative to a top end of the shin guard 100, as illustrated with lines 506 and 508 respectively.

Figure 9:
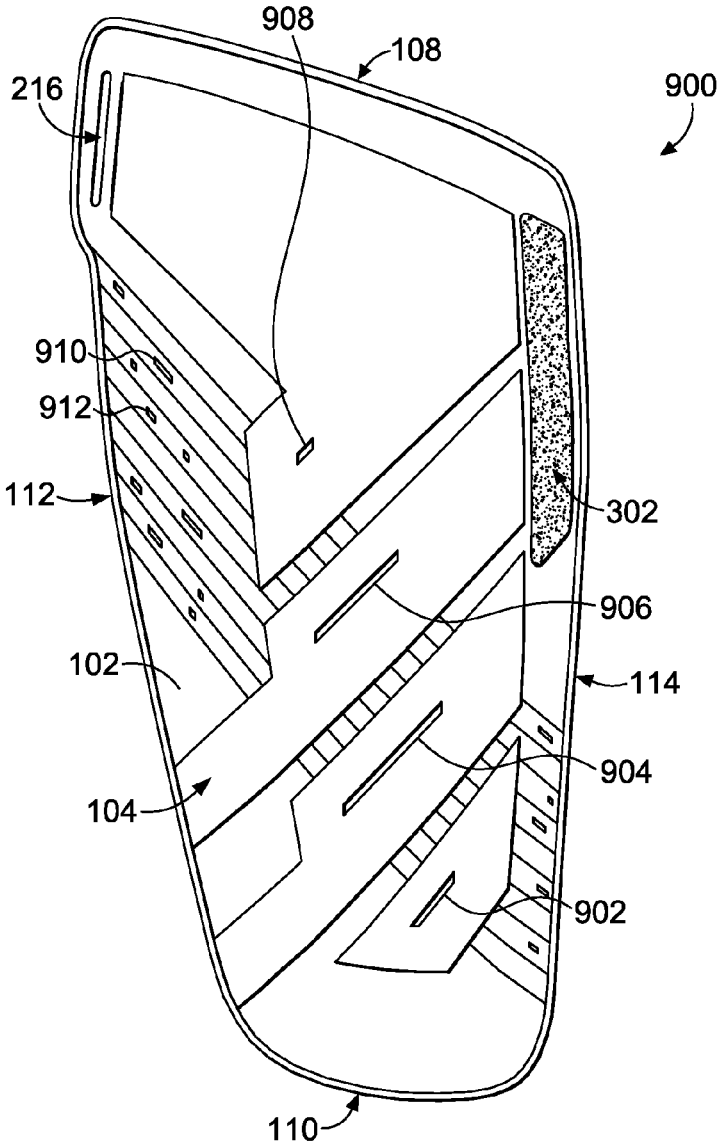
FIG. 9 depicts a front view of another exemplary aspect of a shin guard, in accordance with embodiments of the present invention.

FIG. 9 depicts a frontal view of an additional exemplary shin guard 900, in accordance with aspects of the present invention. Among other features included with the shin guard 900, the shin guard 900 includes a first vent 902, a second vent 904, a third vent 906, and a fourth vent 908. The vents 902-908 are all medially inclined vents. For example, as the vent extends from the lateral side 112 toward the medial side 114, the vent inclines upwardly from the bottom edge 110 towards the top edge 108. Medially inclined vents may allow for airflow to enter the shin guard 900 in a manner that facilitates greater cooling effectiveness proximate a shin region of a wearer. Similarly, the medially inclined vents may facilitate maintaining a relative position when in an in-worn state. For example, if a sleeve or sock is located on an exterior surface of the shin guard 900, the medially inclined vents may provide a tightening effect caused by a medial to lateral rotation as they resist gravity. The medial to lateral rotation may be resisted by a strap (not shown) more effectively than a lateral to medial rotation. However, it is contemplated that a similar result may also be realized with a laterally inclined vent. The shin guard 900 may also include a plurality of laterally inclined vents, such as a fifth vent 910 and a sixth vent 912. The shin guard 900 is also illustrated with the first opening 216, which may be utilized for coupling a strap to the lateral side 112. It is contemplated in this exemplary aspect, as previously discussed, that a single opening (e.g., the first opening 216) may be sufficient without a second opening (e.g., the second opening 218 (not shown)).

Although the shin guard construction is described above by referring to particular aspects, it should be understood that modification and variations could be made to the shin guard construction described without departing from the intended scope of protection provided by the following claims.

The invention claimed is:

1. A shin guard construction comprising:

a shin guard having a bottom end and an opposite top end defining a shin guard length, and having opposite right and left sides extending between the bottom end and the top end, the shin guard having a front surface and a back surface, wherein the front surface comprises a shin guard fastener portion along the right side or the left side, the shin guard fastener portion having a shin guard fastener portion length that extends at least a portion of the shin guard length;

a strap of flexible material having a top edge and an opposite bottom edge and having opposite left and right ends extending between the top edge and the bottom edge, wherein a length of the top edge extending between the left end and the right end is less than a length of the bottom edge extending between the left end and the right end;

one of the right end or the left end of the strap having a first fastener fastenable to the shin guard fastener portion, the other of the right end or the left end having a second fastener fastenable to the strap, wherein the right end or left end having the first fastener forms an acute angle with the bottom edge and an obtuse angle with the top edge; and the strap, when affixed to the shin guard by both the first fastener and the second fastener, inherently extends in an upward inclined orientation and maintains the upward inclined orientation, wherein the upward orientation is measured from a horizontal plane that passes perpendicularly through the front surface and the back surface of the shin guard, wherein the right end or the left end having the first fastener, when affixed to the shin guard, has an outer edge that is substantially perpendicular to the horizontal plane.

2. The shin guard construction of claim 1, wherein one of the right end or the left end of the strap is wider than the other of the right end or the left end of the strap, wherein the width is measured between the top edge and the bottom edge of the strap proximate the respective ends.

3. The shin guard construction of claim 2, wherein the wider of the right side or the left side of the strap is the medial side of the strap in an as-worn position.

4. The shin guard construction of claim 1, wherein the top edge and the bottom edge of the strap are not parallel to each other.

5. The shin guard construction of claim 1, wherein the shin guard further comprises a plurality of openings proximate the top end of the shin guard through which the strap may extend.

6. The shin guard construction of claim 5, wherein the strap proximate the second fastener extends through a first opening of the plurality of openings in a direction from the back surface to the front surface of the shin guard and the strap continues to extend through a second opening of the plurality of openings from the front surface to the back surface of the shin guard, thereby creating a turn back portion of the strap.

7. The shin guard of claim 6, wherein the strap, proximate the second fastener, is affixed to itself.

8. The shin guard of claim 6, wherein the first opening and the second opening are slots having an orientation to facilitate the strap extending in the upward orientation.

9. The shin guard construction of claim 1, wherein the shin guard fastener portion is a hook or loop material having an upper edge and a lower edge, such that a distance between the upper edge and the lower edge is greater than the width of the strap proximate the first fastener.

10. The shin guard construction of claim 9, wherein the strap, proximate the first fastener, is adjustably affixable to the shin guard in a direction extending from the top end to the bottom end of the shin guard.

11. A shin guard construction comprising:

a shin guard having a front surface and a back surface, the shin guard having a bottom end and an opposite top end and having opposite medial and lateral sides extending between the bottom end and the top end, wherein the lateral side is longer than the medial side;

a strap of flexible material having a top edge and an opposite bottom edge and having opposite left and right ends extending between the top edge and the bottom edge, wherein a length of the top edge extending between the left end and the right end is less than a length of the bottom edge extending between the left end and the right end;

the strap is adjustably affixable to the shin guard at a first fastening location comprising a first fastener and corresponding to one of the left end or the right end, and a second fastening location comprising a second fastener and corresponding to the other of the right end or the left end, wherein the right end or the left end having the first fastener comprises an outer edge that forms an acute angle with the bottom edge and an obtuse angle with the top edge; and the strap, when affixed to the shin guard at both the first fastening location and the second fastening location, inherently extends in an upward inclined orientation measured from a horizontal plane that passes perpendicularly through the front surface and the back surface of the shin guard, and wherein when the strap is affixed to the shin guard, the outer edge is substantially perpendicular to the horizontal plane.

12. The shin guard construction of claim 11, wherein the top edge of the strap is higher than the top end of the shin guard as measured in a direction extending from the shin guard bottom end towards the shin guard top end.

13. The shin guard construction of claim 11, wherein the strap has a hook or loop material affixed proximate the first fastening location and at the second fastening location.

14. The shin guard construction of claim 11, wherein the strap is adjustable in a vertical direction, as defined by a line extending from the bottom end toward the top end of the shin guard, at the first fastening location.

15. The shin guard construction of claim 11, wherein a length of the strap extending from the second fastening location to the first fastening location is adjustable at the second fastening location.

16. The shin guard construction of claim 11, wherein the inherently upwardly orientation of the strap, results in the strap resting on an upper portion of the wearer's calf in an as-worn position.

17. The shin guard construction of claim 11, wherein the shin guard is further comprised of a first slot and a second slot sized to receive a portion of the strap.

18. The shin guard construction of claim 17, wherein the first slot and the second slot are oriented proximate the top end of the shin guard so that the strap, after extending through both the first slot and the second slot, maintains the upwardly orientation.

19. A shin guard construction comprising:

a shin guard having a bottom end and an opposite top end and having opposite medial and lateral sides extending between the bottom end and the top end;

the lateral side having a length between the bottom end and the top end longer than a length of the medial side between the bottom end and the top end;

a strap of flexible material having a top edge and an opposite bottom edge and having opposite medial and lateral ends extending between the top edge and the bottom edge;

the medial end of the strap having a width between the top edge and the bottom edge of the strap that is wider than a width of the lateral end between the top edge and the bottom edge of the strap;

the strap having a first fastener proximate the medial end, wherein the strap is affixable to the shin guard proximate the medial side of the shin guard utilizing the first fastener and a shin guard fastener portion along a front face portion on the medial side of the shin guard, wherein the medial end comprises an outer edge that forms an acute angle with the bottom edge and an obtuse angle with the top edge such that when the first fastener is affixed to the shin guard fastener portion, has the outer edge substantially perpendicular to a horizontal plane that passes perpendicularly through the front surface and the back surface of the shin guard;

the strap having a second fastener and a third fastener proximate the lateral end, wherein the strap is affixable to the shin guard proximate the lateral side of the shin guard utilizing the second fastener in conjunction with the third fastener; and the top edge of the strap extends higher than the top side of the shin guard in a direction defined as extending from the bottom end toward the top end of the shin guard when the strap is affixed to the shin guard utilizing both the first fastener and the second fastener.

20. The shin guard construction of claim 1 further comprising a plurality of vents on the shin guard.

* * * * *